US009895875B2

(12) United States Patent
Keil et al.

(10) Patent No.: US 9,895,875 B2
(45) Date of Patent: Feb. 20, 2018

(54) PRINTING UNIT HAVING A PLATE CYLINDER AND PLATE CHANGER

(71) Applicant: KBA-METALPRINT GMBH, Stuttgart (DE)

(72) Inventors: Lars Keil, Würzburg (DE); Bernd Masuch, Kürnach (DE); Wolfgang Reder, Veitshöchheim (DE); Karl Schäfer, Kürnach (DE)

(73) Assignee: KBA-METALPRINT GMBH, Stuttgart (DE)

( * ) Notice: Subject to any disclaimer, the term of this patent is extended or adjusted under 35 U.S.C. 154(b) by 0 days.

(21) Appl. No.: 15/321,399

(22) PCT Filed: Jun. 29, 2015

(86) PCT No.: PCT/EP2015/064646
§ 371 (c)(1),
(2) Date: Dec. 22, 2016

(87) PCT Pub. No.: WO2016/008703
PCT Pub. Date: Jan. 21, 2016

(65) Prior Publication Data

US 2017/0197403 A1 Jul. 13, 2017

(30) Foreign Application Priority Data

Jul. 16, 2014 (DE) ..... 10 2014 213 811
Oct. 20, 2014 (DE) ..... 10 2014 221 220

(51) Int. Cl.
*B41F 27/12* (2006.01)
*B41F 27/00* (2006.01)
*B41F 27/02* (2006.01)

(52) U.S. Cl.
CPC ..... *B41F 27/1206* (2013.01); *B41F 27/005* (2013.01); *B41F 27/02* (2013.01);
(Continued)

(58) Field of Classification Search
CPC ..... B41F 17/22; B41F 27/005; B41F 27/02; B41F 27/12; B41F 27/1206;
(Continued)

(56) References Cited

U.S. PATENT DOCUMENTS 4,822,015 A * 4/1989 Glasman ..... A41H 15/00 269/54.1
5,074,212 A * 12/1991 Kobler ..... B41F 27/1206 101/415.1
(Continued)

FOREIGN PATENT DOCUMENTS

DE 2851426 A1 6/1979
DE 303232780 A1 5/1983
DE 4003445 A1 8/1991
DE 8912194 U1 1/1998
(Continued)

OTHER PUBLICATIONS

International Search Report of PCT/EP2015/064646 dated Sep. 9, 2015.

*Primary Examiner* — Leslie J Evanisko
*Assistant Examiner* — Marissa Ferguson Samreth
(74) *Attorney, Agent, or Firm* — Mattingly & Malur, PC

(57) ABSTRACT

A printing unit has a printing form cylinder. A plate changer is arranged in a manner which is allocated to the printing form cylinder. The plate changer has a bearing surface on which a printing form, which is arranged or is to be arranged on the printing form cylinder, can be laid. That bearing surface is arranged such that it can be moved to and fro between at least two defined positions longitudinally with respect to the rotational axis of the printing form cylinder. The printing form is arranged and registered on the bearing surface of the plate changer. At least two edges of a carrier for the relevant printing form, which are arranged at a right angle with respect to each other, are brought into physical contact with register pins which are arranged on the bearing surface of the plate changer. A first edge of the carrier of the
(Continued)

relevant printing form is arranged to bear against a first register pin and a second edge, orthogonal with respect to the first edge, of the carrier of the relevant printing form, is arranged to bear against a second register pin. The printing unit is preferably arranged as a device for printing hollow bodies.

11 Claims, 6 Drawing Sheets

(52) U.S. Cl.
CPC ..... *B41P 2227/30* (2013.01); *B41P 2227/62* (2013.01); *B41P 2227/63* (2013.01)

(58) Field of Classification Search
CPC ..... B41F 27/1231; B41F 30/00; B41F 30/02; B41F 30/04; B41P 2227/00; B41P 2227/10; B41P 2227/20; B41P 2227/21; B41P 2227/30; B41P 2227/60; B41P 2227/62; B41P 2227/63
See application file for complete search history.

(56) References Cited

U.S. PATENT DOCUMENTS

| | | | | |
|---|---|---|---|---|
| 5,111,747 | A | 5/1992 | Kobler et al. | |
| 5,155,921 | A * | 10/1992 | Banike | B41F 27/02 33/618 |
| 5,806,431 | A | 9/1998 | Muth | |
| 2008/0264284 | A1 * | 10/2008 | Hutchison | B26D 7/2614 101/389.1 |

FOREIGN PATENT DOCUMENTS

| | | | | |
|---|---|---|---|---|
| DE | 19624440 | A1 | 1/1998 | |
| DE | 19620997 | C2 | 3/1998 | |
| DE | 19806579 | * | 4/1999 | B21D 5/002 |
| DE | 19806579 | A1 | 4/1999 | |
| DE | 10160734 | A1 | 7/2002 | |
| DE | 102005044223 | A1 | 3/2007 | |
| DE | 102006004568 | A1 | 8/2007 | |
| DE | 102006032204 | B3 | 10/2007 | |
| DE | 102006048286 | A1 | 4/2008 | |
| DE | 102007052761 | A1 | 5/2008 | |
| DE | 102007035689 | B3 | 10/2008 | |
| DE | 102010001115 | A1 | 7/2011 | |
| WO | 2004-109581 | A2 | 12/2004 | |
| WO | 2012-148576 | A1 | 11/2012 | |

* cited by examiner

PRINTING UNIT HAVING A PLATE CYLINDER AND PLATE CHANGER

CROSS-REFERENCE TO RELATED APPLICATIONS

This application is the U.S. National Phase, under 35 U.S.C. 371, of PCT/EP2015/064646, filed Jun. 29, 2015; published as WO 2016/008703A1 on Jan. 21, 2016 and claiming priority to DE 10 2014 213 811.6, filed Jul. 16, 2014 and to DE 10 2014 221 220.0, filed Oct. 20, 2014, the disclosures of which are expressly incorporated herein by reference.

FIELD OF THE INVENTION

The present invention relates to a printing unit having a printing forme cylinder. A plate changer is provided and is assigned to the printing forme cylinder. The plate changer has a bearing surface on which a printing forme arranged, or to be arranged on the forme cylinder, can be placed. This bearing surface is arranged such as it can be moved back and forth longitudinally with respect to the rotational axis of the printing forme cylinder, between at least two defined positions.

BACKGROUND OF THE INVENTION

As is known, for example, from WO 2012/148576 A1, in a device used in the packaging industry for decorating hollow bodies, each of which has a cylindrical lateral surface, in most cases a plurality of printing units are used. In such cases, each of these printing units transfers a printing ink onto a printing blanket, which is used jointly by these printing units. The lateral surface of the hollow body in question is then decorated with a print motif, e.g. a multicolored print motif, by a relative movement between the lateral surface of the hollow body in question and the printing blanket, in particular by rolling the lateral surface of the hollow body in question along said printing blanket, which has been inked-up in advance, particularly with multiple colors.

A device of this type for printing on or for decorating hollow bodies, each of which has in particular a preferably cylindrical lateral surface, is used, for example, in conjunction with a system for producing such hollow bodies, which typically has a plurality of work stations, wherein the hollow bodies are printed on or decorated by means of a printing process, and therefore these hollow bodies may also be referred to generally as printed products. In such a system, the hollow bodies to be printed on are produced in a large-scale production process in which, for example, several hundred or even several thousand pieces are produced per minute, for example between 1500 and 3000 pieces per minute. Hollow bodies of this type are made of metal, in particular steel or aluminum for example, or are made of plastic. Metal hollow bodies of this type are used, for example, as beverage cans or as aerosol cans. Plastic hollow bodies of this type are produced, for example, in the form of thermoplastic molded articles, and are used, for example, as cartons for packaging liquid or paste-like food products, for example, especially dairy products or beverages. However, the hollow body may also be a round tubular body made of either a plastic or aluminum, with a tube being defined as an elongated, sturdy but malleable container, which is intended for filling particularly with a paste-like substance. Tubes made of aluminum are produced, for example, in a backward extrusion process. Tubes made of plastic are produced as seamless tubes, for example, by means of extrusion. Another type of hollow body that can be printed on in an aforementioned device is containers or receptacles, such as bottles or flasks, preferably cylindrical and made of glass.

Beverage cans are preferably made of aluminum and are typically two-part cans, in which a circular base together with a preferably straight cylinder are fabricated in each case from of a single workpiece, i.e. from a slug or from a blank, i.e. a circular disk, in a forming process, for example in a cold extrusion process or in a tension-pressure forming process, preferably by deep drawing, in particular by ironing and deep drawing, to form a hollow body which is open at one end, i.e. a can blank, and in which, in a final fabrication step, a circular lid is placed on the cylinder and is attached to the cylinder by flanging, forming an air-tight seal.

Tinplate cans are another type of can. Tinplate is tin-plated sheet steel. The thickness of the sheet steel used to produce tinplate cans is 0.15 mm to 0.49 mm, for example, and the thickness of the tin plating is 0.2 μm to 0.8 μm, for example; the tin plating provides protection against corrosion. Tinplate cans are three-part cans. To produce the shell for a tinplate can, a rectangular strip of sheet steel is bent into a preferably straight cylinder, and the ends of this strip that has been bent into a cylinder are welded at a butt joint. A circular base and a circular lid are then placed onto the cylinder and the edges are flanged. To give the tinplate can in question greater strength against dents, each of the three parts, i.e., the cylinder, the base and the lid, for example, preferably has a corrugated profile.

An aerosol can, also called a spray can, is a metal can used for spraying liquids. The liquid filled into an aerosol can is pressurized, and propane, butane, dimethyl ether or mixtures thereof, or compressed air or nitrogen, for example, is used as the propellant for dispensing the liquid from the can.

The aforementioned WO 2012/148576 A1 describes a device for decorating cans, in which an assembly of multiple printing units is provided, each having an inking unit for the multicolored decoration of a plurality of cans, wherein each of the inking units belonging to one of the printing units has an ink fountain for supplying ink, wherein in each ink fountain, an ink fountain roller for receiving the printing ink from the associated ink fountain is provided, wherein in each inking unit, an ink ductor is provided, each ink ductor receiving ink from the ink fountain roller in question, wherein in a roller train situated downstream of the respective ink ductor in the inking unit in question, a plurality of oscillating ink distribution rollers and a plurality of ink transfer rollers, each interacting with at least one of the ink distribution rollers, are provided, wherein for each inking unit, a plate cylinder having at least one printing plate is provided, and only a single ink forme roller cooperates with each plate cylinder to apply the ink.

Known from WO 2004/109581 A2 is an apparatus for carrying out a non-contact digital printing method, e.g. an inkjet printing method, for the optionally individual printing of round objects, more particularly two-part cans, without the use of a printing blanket, wherein a plurality of print heads are preferably provided, each of which prints in a single color of ink.

Known from DE 10 2006 004 568 A1 is a short inking unit for a printing machine, comprising a printing forme cylinder, an ink forme roller which cooperates with the printing forme cylinder, and an anilox roller which contacts the ink forme roller and which is assigned a device for supplying ink, wherein at least one leveling roller is located between the point to which ink is supplied and the contact gap between the anilox roller and the ink forme roller, relative to the direction of rotation of the anilox roller, and the device for supplying ink is embodied as a chamber doctor blade.

Known from DE 101 60 734 A1 is a printing machine comprising at least one printing forme, a dampening unit for dampening the printing forme with a dampening medium, an inking unit for inking up the printing forme with an ink, and a dehumidifying device which has a heated roller (temperature control roller) for reducing the amount of dampening medium that is conveyed together with the ink, wherein the inking unit is configured as a leverless short inking unit, wherein an inking unit roller of the inking unit has a first rolling contact point where the inking unit roller is in rolling contact with the heated roller, wherein the inking unit roller has a second rolling contact point, and wherein the shortest conveyance path of the ink from the inking unit roller to the printing forme via at most one intermediate roller is predetermined.

Known from DE 32 32 780 A1 is an inking unit for offset printing machines used for printing sheets or webs with a plate cylinder that receives the necessary ink from at most two ink forme rollers that have an elastic surface and that cooperate with an inking cylinder to which the ink is supplied via an ink feed system that produces a continuous ink film, wherein located downstream of the inking cylinder is an ink forme roller having nearly the same diameter as the plate cylinder, wherein a dampening unit having at least one roller for transferring the dampening medium is assigned to the inking cylinder, and wherein the dampening medium is transferred to the inking cylinder in the direction of rotation thereof, downstream of ink application and upstream of the point of contact between the inking cylinder and the ink forme roller.

Known from DE 10 2006 048 286 A1 is a method for driving a printing unit that has a short inking unit in a processing machine that has an anilox roller and an associated doctor blade device, along with an ink forme roller located downstream of the anilox roller and a plate/forme cylinder downstream of the ink forme roller in the direction of ink flow, wherein the plate/forme cylinder is operatively connected to a rubber blanket cylinder and the rubber blanket cylinder is operatively connected to a printing cylinder which guides the printing substrate, wherein the anilox roller is driven by an independent drive, wherein during printing/varnishing operation, the main drive supplies an input drive to a drive wheel of the printing cylinder and to a drive wheel of the rubber blanket cylinder and to a second and a first drive wheel of the plate/forme cylinder and to a drive wheel of the ink forme roller and to a drive wheel of the anilox roller, while the independent drive of the anilox roller is inactive, and wherein during setup operation, the drive connection to the main drive between first drive wheel and second drive wheel of the plate/forme cylinder is disconnected, the independent drive of the anilox roller is activated, and the independent drive applies drive torque to the drive wheel of the anilox roller and to the drive wheel of the ink forme roller and to the first drive wheel of the plate/forme cylinder.

Known from DE 196 24 440 A1 is a device for filling depressions in a cylinder of a printing machine with a fluid, wherein at least two doctor blade devices for filling depressions in the cylinder with the fluid are arranged on the cylinder, wherein a device for applying the fluid, connected to a conveyance system, and a working doctor blade located downstream of said application device in the direction of rotation of the cylinder are provided, wherein the doctor blades are attached to a bar, and wherein the fluid that is wiped off is drained to a collection basin.

Known from DE 89 12 194 U1 is an inking unit for use in a printing machine, which has a working doctor blade that can be placed against an anilox roller and an ink trough with ink conveying means, wherein the working doctor blade, the ink trough, and the means for conveying the ink to the anilox roller are combined to form a single structural unit, and the structural unit can be removably fastened to a carrier which is mounted on the printing machine.

Known from DE 10 2007 052 761 A1 is an anilox printing unit, comprising as inking unit rollers an ink forme roller and an anilox roller, wherein the anilox roller is mounted on pivoting levers, wherein the anilox roller and the ink forme roller each have bearer rings, and wherein a device for pressing the bearer rings of one inking unit roller against the bearer rings of the other inking unit roller has springs to compensate for diameter differences due to manufacturing tolerances.

Known from DE 28 51 426 A1 is a device for printing the lateral surface of hollow bodies, wherein a transport device is provided for transporting the hollow bodies to be printed about a rotational axis, wherein a plurality of printing units are provided, wherein each hollow body to be printed can be transported by means of the transport device into the printing area of at least one of the printing units, and wherein at least one of the printing units has a printing forme cylinder and an inking unit with a single ink forme roller.

Known from DE 10 2006 032 204 B3 is a method for supplying at least one printing forme to the location where it will be mounted on a forme cylinder of a rotary printing machine, wherein the printing forme, which has been imaged with a print motif, is transported by means of a transport device to the location where it will be mounted on the forme cylinder, wherein the printing forme is transported by means of a transport module that is connected to the transport device, and wherein the printing forme is mounted in its mounting location on the forme cylinder from the transport module.

Known from DE 10 2005 044 223 A1 is a printing unit of a web-fed rotary printing machine, said printing unit having a forme cylinder and a transfer cylinder which rolls on the forme cylinder, wherein a plurality of printing plates can be clamped on the forme cylinder side by side as viewed in the axial direction thereof, and a plurality of printing plates can preferably be clamped on the forme cylinder one in front of the other as viewed in the circumferential direction of the same, said printing unit also having a printing plate changing device assigned to the forme cylinder for the automatic changing of printing plates on the forme cylinder, wherein the printing plate changing device comprises an actuating head that can be moved translationally along the forme cylinder for the purpose of releasing or unlocking, and for securing or locking printing plates on the forme cylinder, and/or a changing cartridge that can be moved translationally along the forme cylinder for the purpose of holding new or replacement printing plates in reserve and for receiving old or replaced printing plates.

Known from DE 40 03 445 A1 is an automatic plate supplying and cylinder loading system for a rotary printing machine, having a handling apparatus for removing a printing plate from a container and applying the printing plate onto a plate cylinder of the printing unit, and also for removing a printing plate from a plate cylinder and placing the printing plate in the container, wherein the handling apparatus is guided along a path that extends substantially parallel to the axis of rotation of the plate cylinder to be loaded, wherein a carriage for transporting a plurality of printing plates up to a printing unit or away from one of these printing units is provided, and wherein the carriage is guided along a path that extends substantially perpendicular to the path of the handling apparatus.

Known from DE 10 2007 035 689 B3 is a method for arranging printing formes on a forme cylinder of a printing machine, wherein one of the printing formes is located in each of a plurality of mounting positions arranged side by side in the axial direction of the forme cylinder, wherein, before being arranged in one of the mounting positions on the forme cylinder, each of the printing formes is stored in a storage position of a storage device which has a plurality of storage positions arranged side by side axially along the forme cylinder and spaced at a fixed distance from one another, wherein once a first printing forme has been arranged on the forme cylinder, this forme cylinder and/or the storage device are displaced axially relative to one another along an adjustment path, such that as a result of this displacement, an additional printing forme to be arranged on the forme cylinder is arranged at a mounting position on the forme cylinder that is located adjacent to the mounting position of the previously arranged printing forme, at a reduced distance relative to the distance between two adjacent storage positions of the storage device.

Known from DE 196 20 997 C2 is a method for axially positioning a printing plate while it is being applied to a cylinder of a rotary printing machine, wherein the printing plate is transported to the cylinder by means of transport means, wherein a section of the cylinder where the printing plate will be applied is selected, wherein a desired position for the printing plate on the cylinder is selected from a plurality of possible, preselectable positions assigned to said cylinder section and lying axially side by side, after which the position of the printing plate in the axial direction relative to a reference position on the cylinder is determined, and wherein finally, the printing plate is moved to the preselected position.

Known from DE 10 2010 001 115 A1 is a device for furnishing at least one printing forme to a printing machine, wherein the furnishing device has at least one guide element, and wherein at least one transport container arranged on a holding device is arranged as movable in an axial direction along the at least one guide element with respect to a forme cylinder that can be loaded with the at least one printing forme, and wherein at least one printing forme out of the at least one transport container can be arranged on the at least one forme cylinder, wherein at least one transport container is embodied as a changing magazine, and wherein the at least one changing magazine is detachably arranged on the at least one holding device, and wherein at each transfer position of the furnishing device on which a changing magazine can be arranged, at least one other changing magazine can be arranged in its place.

Known from DE 198 06 579 A1 is a method for precisely positioning an exposed printing plate which is also provided with register marks imprinted in the precise position for this image, wherein the printing plate is supplied on an alignment table which is mounted so as to be displaceable in a horizontal plane in orthogonal coordinates (x, y) and so as to be pivotable in this plane, and then, by displacing the alignment table, the printing plate is moved into a target position based on the detection of the register marks, in which position punch outs and optionally bent parts of the printing plate are applied appropriately for affixing of the image of the printing plate in the proper position on a printing roller, wherein as the printing plate is being supplied, it is pushed beyond the target position, later defined, against stops that are arranged in the system of coordinates (x, y), wherein the printing plate is then secured in this position on the alignment table, wherein the alignment table is then displaced by means of servo drives actuated in a pulsed manner, in the direction of the target position, first along one of the coordinates (x) with a detection of correspondingly arranged register marks during a pivot angle correction occurring as part of this positioning movement, and then along the other coordinate (y), with the detection of a correspondingly arranged register mark, wherein during the positioning movements the register marks are detected by means of optoelectronic sensor elements arranged stationary relative to the punching tools, specifically by the fact that each of the servo drives is moved in the positioning direction until the assigned sensor element reports the associated register mark as present, and after passing over it, indicates the register mark as no longer present, this traversing path segment between the report and the indication being stored by counting the pulses of a path segment-dependent series of pulses, whereupon the servo drive is stopped and is driven in the opposite positioning direction until the assigned sensor element reports the register mark now being approached from the opposite direction as present, said opposite positioning path segment up to this report being stored by counting the pulses of a path segment-dependent series of pulses, which subtracts the two stored values from one another and divides this differential value in half, and the servo drive is moved further by the path segment corresponding to this number of pulses in the opposite positioning direction, so that the switching hysteresis of the scanning element is compensated for and the precise position of the register mark is adjusted centered relative to the sensor element, whereupon the punching process is carried out.

SUMMARY OF THE INVENTION

The object of the present invention is to provide a printing unit having a printing forme cylinder, on which a printing forme change that is true to register can be performed in a simple manner.

The object is achieved according to the invention by the provision of the printing forme being arranged true to register on the bearing surface of the plate changer. At least two edges of a carrier of the printing forme in question, which are disposed at right angles relative to one another, are brought into physical contact with register pins arranged on the bearing surface of the plate changer. A first edge of the carrier of the printing forme in question is disposed so as to strike a first register pin and a second edge of the carrier of the printing forme in question, orthogonal to the first edge, is arranged so as to strike a second register pin.

BRIEF DESCRIPTION OF THE DRAWINGS

An exemplary embodiment of the invention is illustrated in the set of drawings and will be described in greater detail in the following. Advantages that are achievable with the invention will be discussed in connection with the exemplary embodiment.

The drawings show.

DESCRIPTION OF THE PREFERRED EMBODIMENT

In a preferred embodiment, a print motif, i.e. at least one print image, for example multicolored, is printed onto the lateral surface, in particular, of a hollow body in a letterpress printing process. Alternative printing processes include, for example, a screen printing process or an offset printing process or a digital printing process in which no printing formes are used. In the following, the invention will be described by way of example in connection with a letterpress printing process. To implement the letterpress printing process, a printing plate is arranged as a printing forme on the lateral surface of a printing forme cylinder, in particular a plate cylinder. The printing plate, which is ready for use in the printing process, is a printing forme that has a print relief, this print relief presenting a mirror image of the print image intended for the printing process, and in an error-free print operation only the print relief is involved in the transfer of ink that has been supplied by the inking unit to the plate cylinder onto the printing blanket. The printing forme 48 or the printing plate 48 has a plate-shaped, preferably flexible carrier 50 of finite length, for example, made from a steel sheet, with a flexible printing body of that printing forme or printing plate 48 in particular being arranged on this carrier 50. At least the opposite ends of the carrier 50 in the circumferential direction of the plate cylinder may be pre-curved, for example corresponding to the curvature of the lateral surface of the plate cylinder, or may also be bent to enable easier mounting of the printing forme, in this case particularly the printing plate, on the plate cylinder. The carrier 50 of the printing forme 48 or the printing plate 48 has a thickness ranging from 0.2 mm to 0.3 mm, for example. The total thickness of the printing plate 48 including its carrier 50 ranges from 0.7 mm to 1.0 mm, for example, and is preferably about 0.8 mm. The printing body of the printing forme 48 is made of plastic, for example. To produce the printing plate 48 which is ready for use in the printing machine, the printing body of the printing plate 48 is exposed, for example, with a negative film that mirrors the print image, and unexposed areas are then removed from the printing body, e.g. by washing or by means of a laser.

Figure 5:
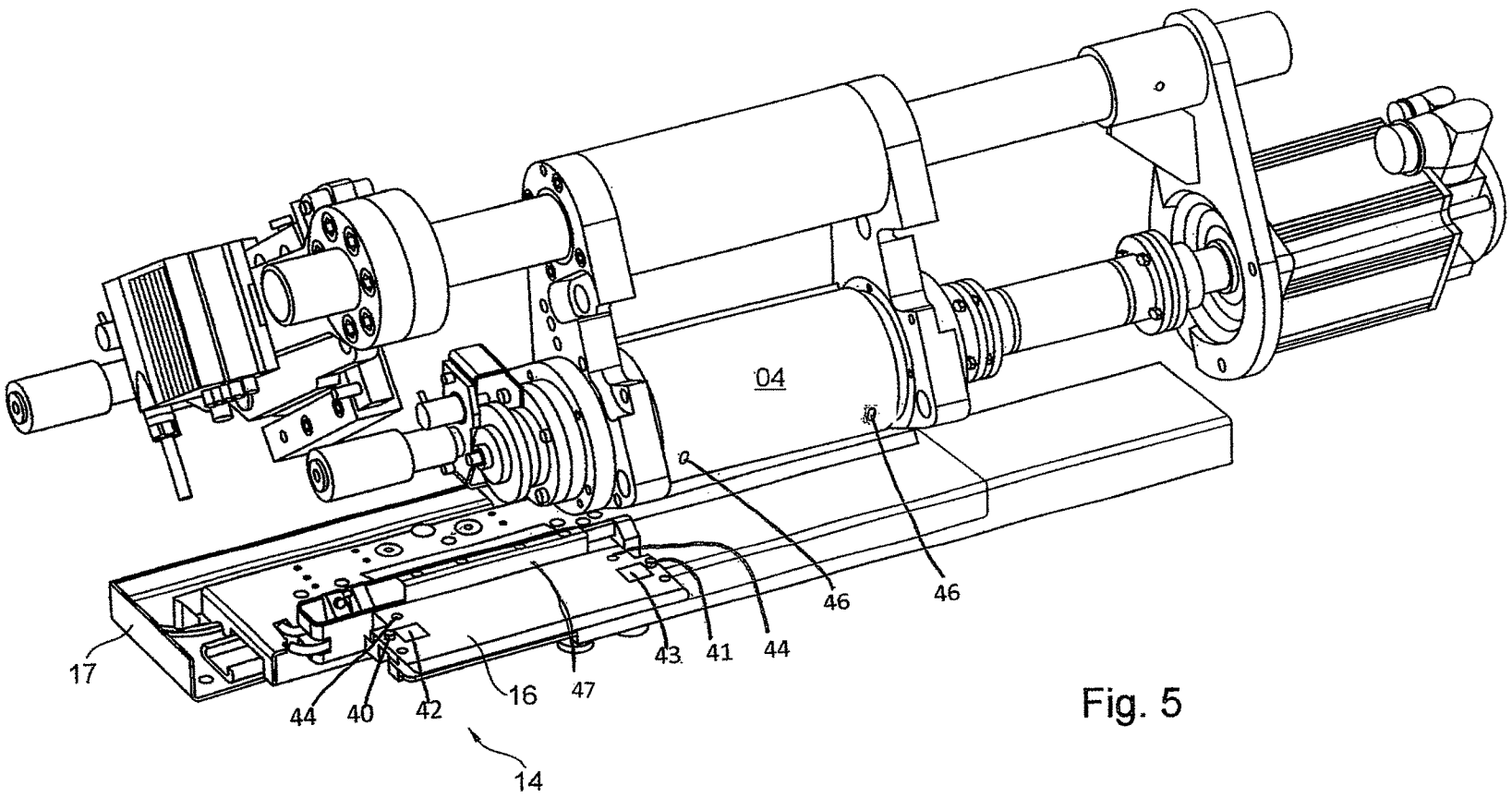
FIG. 5 a plate changer in a first operating position.
Figure 6:
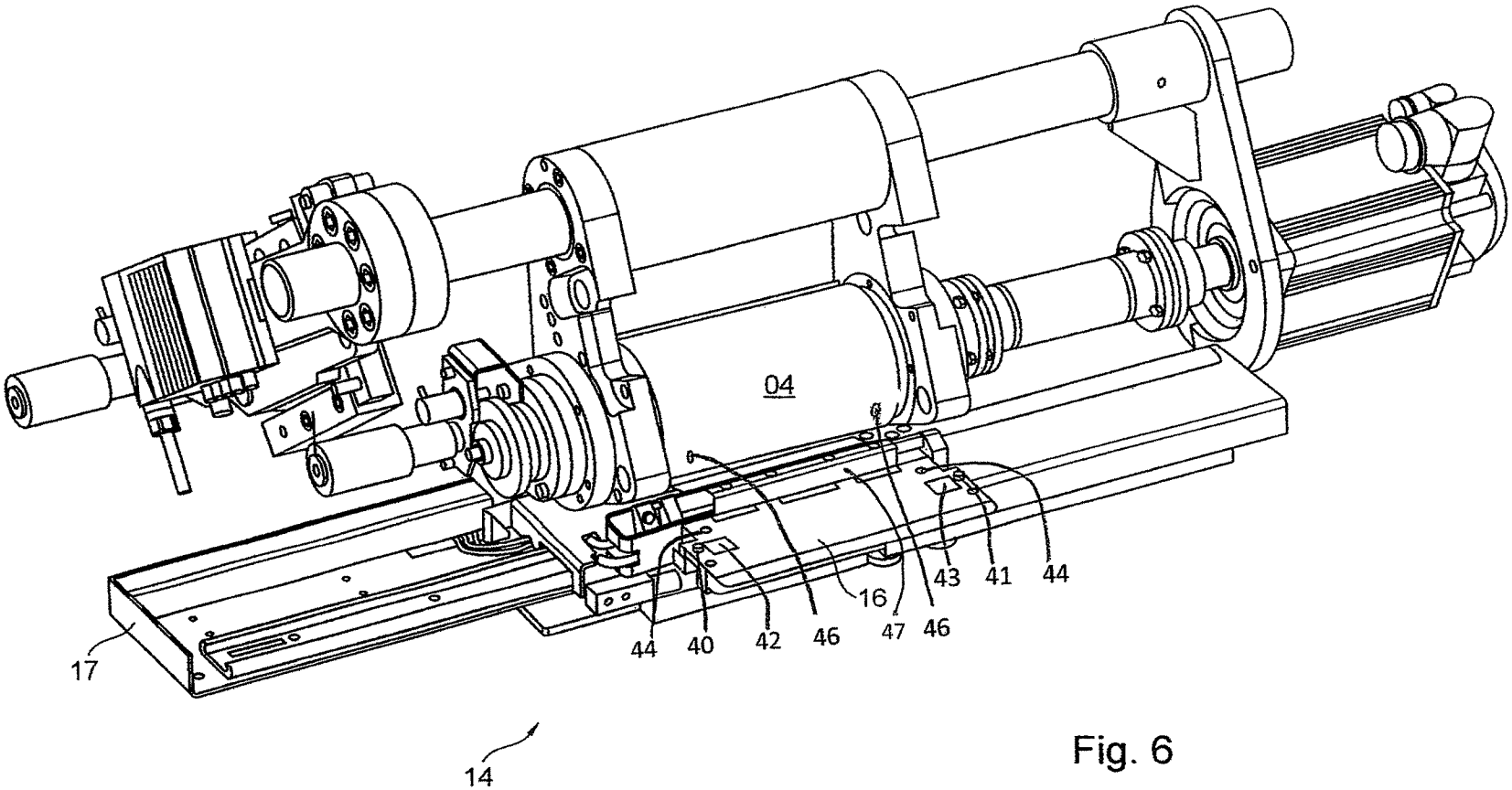
FIG. 6 the plate changer of FIG. 5 in a second operating position.

A device for printing on or decorating hollow bodies, each of which has in particular a preferably cylindrical lateral surface, preferably has a plurality of printing units, for example eight or ten or even more—also called printing stations—, wherein at least one of these printing units, and in the preferred embodiment each of these printing units, has a rotatable printing forme cylinder, more particularly a printing forme cylinder embodied as a plate cylinder. The printing units or printing stations and optionally also the printing forme cylinders in this device are each mounted in a frame and can be used in the same printing process to produce a print motif in multiple colors on the same hollow body, the number of colors corresponding to the number of printing units or printing forme cylinders involved. Each printing forme cylinder or plate cylinder is preferably mounted as a cantilevered component, in which the printing forme cylinder or plate cylinder in question is mounted at one of its end faces, for example on a preferably conical journal. On the lateral surface of each plate cylinder, typically only a single printing plate is arranged, with the carrier of the printing plate fully or at least largely spanning the circumference of the plate cylinder in question, in particular more than 80% thereof. The length of the printing body of the printing plate in the circumferential direction of the plate cylinder in question is preferably shorter than the circumference of the plate cylinder in question. The printing forme or the printing plate is or at least can be arranged particularly magnetically by means of its carrier on the lateral surface of one each of the plate cylinders, that is to say, the printing forme or the printing plate preferably is or will be held in place there magnetically, i.e. by means of a magnetic holding force provided by magnets 46, as shown in FIGS. 5 and 6. In an alternative or supplemental variant of the device for printing on or decorating hollow bodies, each of which has a preferably cylindrical lateral surface, at least one of the printing units, or each of a plurality of these printing units, is embodied as a printing unit that prints in a digital printing process without the use of printing formes, with such a printing unit particularly having at least one inkjet print head or a laser.

The especially simultaneous transfer of a plurality of inks in particular to the lateral surface of the hollow body in question requires proper register to be maintained during ink transfer in order to achieve good print quality in the printing process. To ensure a true-to-register arrangement of the printing forme 48 or the printing plate 48 on the lateral surface of the respective printing forme cylinder or plate cylinder, in the preferred embodiment a plurality of register pins, e.g. the position of each of which is adjustable, is preferably provided on the lateral surface of the printing forme cylinder or plate cylinder in question, which pins engage in corresponding recesses formed on the printing forme or on the printing plate, thereby giving the printing forme or printing plate a defined position in its arrangement on the lateral surface of the printing forme cylinder or plate cylinder in question. In a preferred embodiment, each printing forme cylinder or plate cylinder has a diameter of between 100 mm and 150 mm, more particularly between 120 mm and 130 mm, and the axial length of each printing forme cylinder or plate cylinder is between 200 mm and 250 mm, for example, more particularly between 200 mm and 220 mm. The printing plate to be arranged on the lateral surface of the plate cylinder in question has a width in the axial direction of the plate cylinder in question that ranges from 150 mm to 200 mm, and is preferably about 175 mm.

Each printing forme cylinder used in the printing process and embodied, for example, as a plate cylinder transfers a specific ink with its printing forme or with its printing plate onto a printing blanket. The inks used are typically premixed inks, particularly specially customized inks, which are specifically matched in terms of their respective printability to the material of the hollow body to be printed on, depending on whether the surface to be printed on is made of aluminum, tinplate or plastic, for example. In a preferred embodiment of a device for printing on or decorating hollow bodies, each of which has, for example, a cylindrical lateral surface, a device for transferring ink from the printing forme or the printing plate to the lateral surface of the hollow body in question is provided. This device for transferring ink is embodied, e.g. as a segmented wheel that rotates about a preferably horizontal rotational axis, wherein a plurality of printing blankets preferably are or at least can be arranged one in front of the other on the periphery of this segmented wheel, i.e. along its circumference. As an alternative to the segmented wheel, and depending on the printing process that is used, the device for transferring ink may also be embodied as a decorating drum or as a printing blanket cylinder or as a transfer cylinder, each of which is rotatable about a respective axis of rotation, at least during printing. The printing blankets are arranged on the periphery of the segmented wheel, for example, by attaching each of the printing blankets to the periphery of the segmented wheel, for example, by an adhesive connection, preferably by gluing. Each of the preferably multiple printing forme cylinders or plate cylinders is or at least can be thrown radially onto the printing blankets that are arranged on the periphery of the respective segmented wheel. In a particularly preferred embodiment of a device for printing on or decorating hollow bodies, each of which has, for example, a cylindrical lateral surface, a greater number of printing blankets are provided one in front of the other along the periphery of the segmented wheel than the number of printing forme cylinders or plate cylinders which are or at least can be thrown onto the segmented wheel. The device for transferring ink, preferably in the form of a carousel, more particularly the segmented wheel, has a diameter, for example, of 1500 mm to 1600 mm, preferably approximately 1520 mm to 1525 mm, and when eight printing forme cylinders or plate cylinders are assigned to said device, for example, it has twelve printing blankets, for example, arranged one in front of the other around its periphery. The surface of each of the printing plates is preferably embodied as having a greater hardness than the hardness of the respective surface of the printing blankets. The surface of the printing blankets is preferably flat, i.e. without profiling. In an operating mode in which the printing forme cylinders or plate cylinders involved in the printing process are each thrown radially onto the printing blankets of the rotationally driven segmented wheel, the respective printing formes of each printing forme cylinder or the respective printing plates of each plate cylinder roll along the printing blankets that are moved with the segmented wheel, wherein each of the printing plates presses at least its print relief 0.2 mm to 0.25 mm deep, for example, into the respective printing blanket, thereby producing a flattened area, i.e. a roller strip, extending in the axial direction of the segmented wheel, in the printing blanket in question. The intensity of flattening can be or is adjusted, for example, prior to or at the start of a printing process, for example, by means of remote control, by adjusting a contact force exerted by the relevant printing forme cylinder or plate cylinder on the printing blanket of the segmented wheel in question.

Each of the hollow bodies to be printed on here by way of example, for example each of the two-part cans to be printed on, is moved, for example, by means of a transport device that preferably transports the hollow bodies to be printed on along at least a portion of a circular path, that is, a circular arc, around a rotational axis, preferably by means of a feed wheel, in particular by means of a mandrel wheel, in a continuous movement or with adjusted speed, up to at least one of the printing units belonging to the device for printing on hollow bodies, each of which has a lateral surface, and is thereby transported into a printing area of at least one of these printing units. For example, each of the hollow bodies to be printed on is moved by means of the transport device, embodied, for example, as a feed wheel, up to at least one of the printing blankets arranged, for example, on the segmented wheel, or each of the hollow bodies to be printed on is transported directly and immediately, i.e. without assistance of a device for transferring ink, embodied for example as a segmented wheel, into the respective printing area of at last one of these printing units, which is the case when the printing unit in question prints in a direct printing method, for example in an inkjet printing method.

The feed wheel or mandrel wheel, which, like the segmented wheel, for example, rotates about a preferably horizontal axis, has a plurality of holders, e.g. 24 or 36, each in the form of a clamping mandrel or a spindle that projects outward from a face of the mandrel wheel, for example, with these holders being arranged concentrically to the circumferential line of the feed wheel or mandrel wheel and preferably in an equidistant distribution, wherein each holder holds or at least can hold one of the hollow bodies to be printed on. A transport device embodied as a mandrel wheel is also sometimes referred to as a turntable with spindles. A mandrel wheel is described, for example, in EP 1 165 318 A1. A description of suitable holders, spindles or clamping mandrels may be found, for example, in WO 2011/156052 A1. In the following, each clamping mandrel will be referred to simply as a mandrel. The longitudinal axis of each mandrel is aligned parallel to the rotational axis of the mandrel wheel. In the case of hollow bodies to be printed on, each of which is formed, for example, as a two-part can, each of these hollow bodies is moved, for example by means of a conveyor device, for example a belt conveyor, up to the transport device embodied, for example, as a mandrel wheel, where it is pulled, at a transfer station, onto one of the mandrels of the mandrel wheel by suction, for example by means of a vacuum, and is then held by the mandrel in question, while the transport device embodied as a mandrel wheel transports the respective hollow body to be printed on, for example, to the segmented wheel which is loaded with at least one printing blanket, and thus in the direction of at least one of the printing units, or in an alternative embodiment that has no segmented wheel, for example, directly to at least one of the printing units. Typically, a large number of hollow bodies to be printed on are fed in rapid succession by the conveyor device to the mandrel wheel. A conveyor device of this type is described, for example, in EP 1 132 207 A1.

A gap measuring 0.2 mm in width, for example, is preferably formed between an inner wall of the respective hollow body to be printed on and the surface of the respective mandrel of the mandrel wheel, and therefore the hollow body to be printed on is not held on the mandrel in question by means of a press fit. Each mandrel can be rotated by means of a motor, for example, about its respective longitudinal axis and is particularly adjustable to a specific circumferential speed, so that in addition to being rotated by the mandrel wheel, each hollow body to be printed on that is held by a mandrel can be rotated by rotation that is or at least can be carried out separately by the mandrel. The hollow body to be printed on is preferably pulled onto one of the mandrels of the mandrel wheel during a phase when the mandrel in question is stationary; during said stationary phase, the mandrel in question executes no rotating movement about its own longitudinal axis. The occupancy of each mandrel by a hollow body to be printed on is preferably verified, for example in a contactless manner by means of a sensor. If a mandrel is not occupied by a hollow body to be printed on, the mandrel wheel is moved, for example, in such a way as to reliably prevent any contact of the unoccupied mandrel with a printing blanket of the segmented wheel.

Two-part cans to be printed on are deep-drawn from a circular blank, for example, in a processing station upstream of the mandrel wheel, before being fed to the mandrel wheel.

In a further processing station, the edge of each two-part can is trimmed at its open end face. In additional processing stations each two-part can is washed, for example, in particular its inside is washed out. The hollow bodies, each of which is embodied, for example, as a two-part can, may also optionally be given a finish coat in a coating station. At least the exterior lateral surface of each two-part can is primed, for example, particularly with a white primer. Once the printing on its lateral surface is complete, each two-part can is removed from its respective holder, for example, on the mandrel wheel, for example by means of compressed air or by means of a preferably reversible magnet, and is fed to at least one processing station situated downstream of the mandrel wheel, for example to an optional additional coating station, for coating the exterior lateral surface of each imprinted two-part can and/or to an edge processing station. The imprinted two-part cans are especially passed through a dryer, for example, a hot air dryer, to cure the at least one ink that has been applied to their respective lateral surfaces.

The printing process for printing particularly on the lateral surface of each of the hollow bodies, more particularly two-part cans, held on the mandrel wheel, for example, begins with each of the inks that are required for the print image that will be printed onto the lateral surface of each hollow body being applied, for example by the respective printing plate of the plate cylinder, which is thrown, for example, onto the segmented wheel, onto the same one of the printing blankets arranged on the periphery of the segmented wheel. The printing blanket that has been inked up in this manner with all the required inks then transfers these inks simultaneously, by means of physical contact between the printing blanket and the lateral surface of the respective hollow body to be printed on, onto the lateral surface of this hollow body during a single revolution of the hollow body to be printed on, which is held on one of the mandrels of the mandrel wheel, about its own longitudinal axis. During the transfer of the inks from the printing blanket onto the lateral surface of the hollow body, the hollow body to be printed on, which is held by one of the mandrels of the mandrel wheel, for example, is rotated at a circumferential speed equal to that of the respective printing blanket arranged, for example, on the periphery of the segmented wheel. The respective circumferential speeds of hollow body and printing blanket or segmented wheel are thus synchronized with one another, with the hollow body to be printed on, which is held, for example, on one of the mandrels of the mandrel wheel, being accelerated appropriately from a stationary position, for example, beginning from its first point of contact with the printing blanket in question and continuing as its lateral surface rolls along a path of the first, e.g. 50 mm of the circumferential length of the printing blanket, particularly until it reaches the circumferential speed of the segmented wheel, for example. The segmented wheel that supports the printing blanket in question thus defines the circumferential speed to be adjusted at the respective mandrel of the mandrel wheel, for example. The circumferential speed of the printing forme cylinder that supports the printing forme or of the plate cylinder that supports the printing plate preferably also is or will be adjusted based on the circumferential speed of the segmented wheel, for example. The mandrel wheel and the segmented wheel are driven, for example, by the same central machine drive and are optionally coupled to one another mechanically, for example via a gear set. Alternatively, the mandrel wheel and the segmented wheel are each driven separately by an independent drive, and the rotational behavior of each is controlled, for example, by a control unit.

In the following, various details relating to the above-described device for printing on or decorating hollow bodies in particular, each of which has a cylindrical lateral surface, for example, will be described by way of example, with reference to the aforementioned six figures. However, the individual assemblies specified below may also be used on or in printing machines and/or printing units other than the preferred embodiment discussed herein by way of example.

Figure 1:
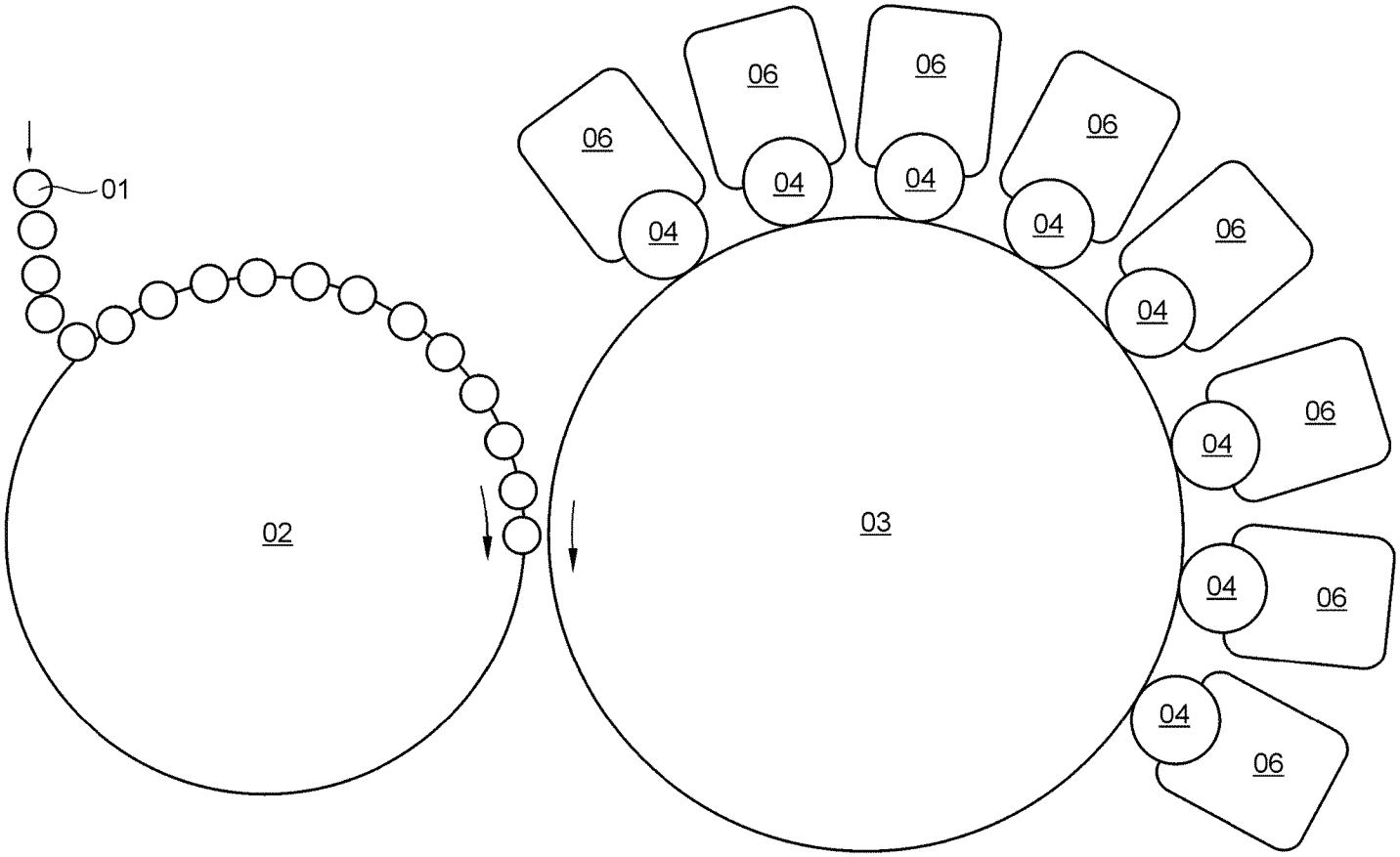
FIG. 1 a device for printing on or decorating hollow bodies, each of which has a lateral surface.

FIG. 1 shows a schematic, simplified representation of an example of a generic device for printing on or decorating hollow bodies 01, for example two-part cans 01, each of which preferably has a cylindrical lateral surface in particular, wherein these hollow bodies 01 are fed sequentially, for example, by a conveyor device to the transport device, embodied, for example as a rotating or at least rotatable feed wheel, in particular as mandrel wheel 02, where each is held individually on this transport device on a holder. In the following, due to the selected embodiment example for the printing machine or the device for printing on hollow bodies, it is assumed that this transport device is preferably embodied as a mandrel wheel 02. A device for transferring ink, for example a rotating or at least rotatable segmented wheel 03, around the periphery of which a plurality of printing blankets are arranged one in front of the other, preferably cooperates with mandrel wheel 02. Assigned to segmented wheel 03, which is specified by way of example, and arranged along its circumferential line, a plurality of printing forme cylinders 04, in particular plate cylinders 04, that are or at least can be thrown radially onto this segmented wheel 03 are provided, with a printing forme, in particular a printing plate, being arranged on the lateral surface of each of these printing forme cylinders 04 or plate cylinders 04, said printing plate being suitable in particular for implementing a letterpress printing process. A specific ink is fed by means of an inking unit 06 to each of the printing forme cylinders 04 or plate cylinders 04 to ink up its printing forme or its printing plate, respectively. In the following it is assumed, by way of example, that each of the printing forme cylinders 04 is embodied as a plate cylinder 04 that carries at least one printing plate.

Figure 2:
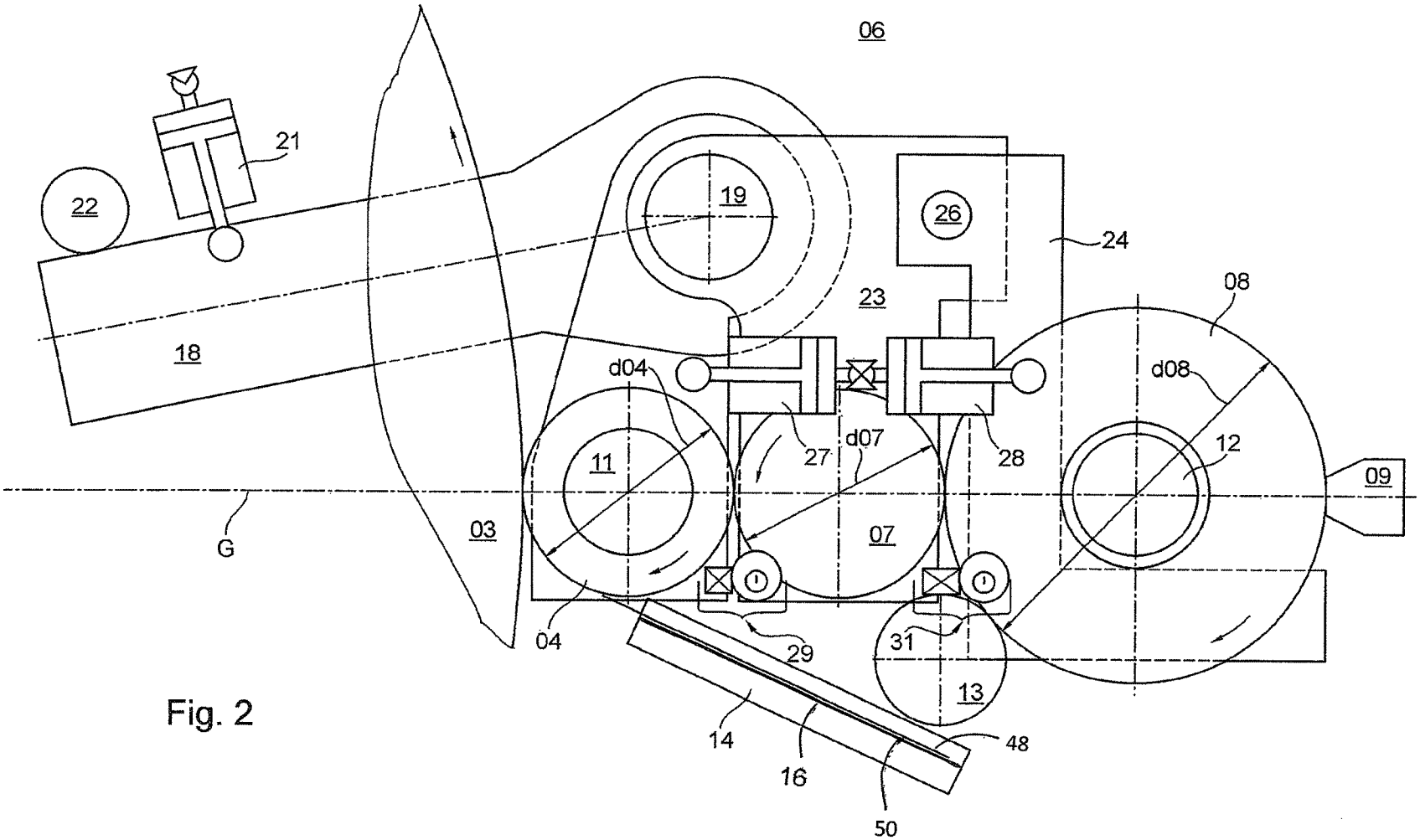
FIG. 2 an inking unit, particularly for the device shown in FIG. 1, in a first operating position.
Figure 3:
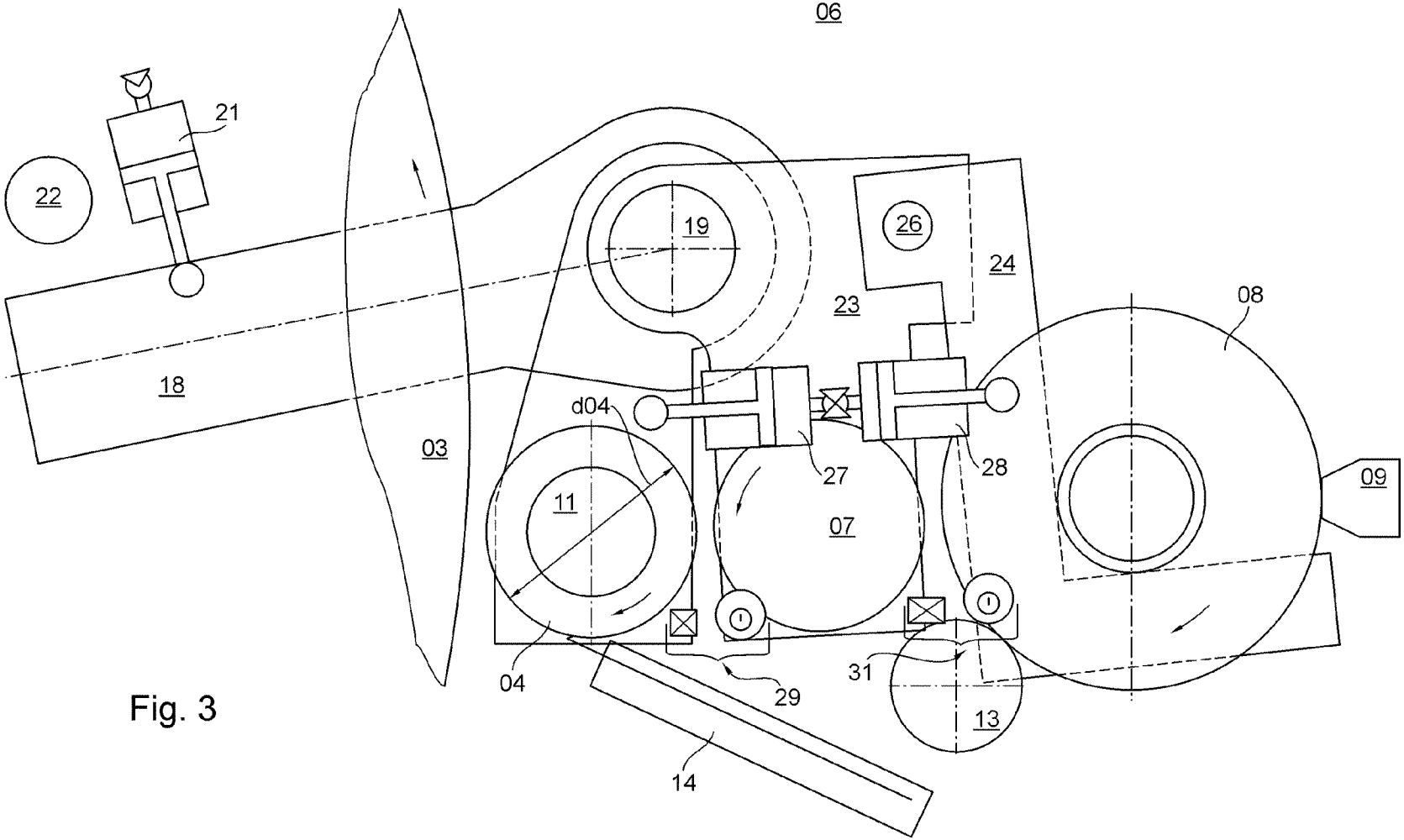
FIG. 3 the inking unit, particularly for the device shown in FIG. 1, in a second operating position.

FIGS. 2 and 3 show a simplified schematic representation of a number of details of inking unit 06, one of which cooperates with each plate cylinder 04, and which is provided, for example, for use in the device shown in FIG. 1 particularly for printing on or decorating hollow bodies 01, each of which has a preferably cylindrical lateral surface. For transporting ink from an ink reservoir to the plate cylinder 04 in question, the inking unit 06 proposed here advantageously has a very short roller train, that is to say, consisting of only a few and preferably a maximum of five rollers, more particularly a two-roller train. In the case of a two-roller train, said roller train consists of only a single ink forme roller 07 and one inking unit roller 08, preferably embodied as an anilox roller 08. An inking unit 06 with a roller train consisting of no more than five rollers is classified as a short inking unit.

FIG. 2 shows an example of a (short) inking unit 06 having a two-roller train in a first operating position, in which ink forme roller 07 and anilox roller 08 are thrown onto one another, ink forme roller 07 is thrown onto plate cylinder 04, and plate cylinder 04 is thrown radially onto the device that transfers ink from plate cylinder 04 to the lateral surface of the respective hollow body 01, more particularly onto segmented wheel 03. FIG. 3 shows a second operating position for the inking unit 06 shown in FIG. 2, in which ink forme roller 07 and anilox roller 08 are thrown off of one another, ink forme roller 07 is thrown off of plate cylinder 04, and plate cylinder 04 is thrown off of the device for transferring ink, more particularly from segmented wheel 03. The throw-on and throw-off mechanism will be described further below.

Printing forme cylinder 04, preferably embodied as a plate cylinder 04, and inking unit roller 08, preferably embodied as an anilox roller 08, are each independently rotationally driven by a motor 11; 12, for example, particularly in the preferred inking unit 06 as shown in FIGS. 2 and 3, wherein the rotational speed and/or angular position of each motor 11; 12 is controlled in particular, or at least can be controlled, by means of an electronic control unit, for example. The device for transferring ink, embodied as segmented wheel 03, for example, is rotationally driven by an independent drive, for example, or by a central machine drive. Ink forme roller 07 is rotationally driven by anilox roller 08 by means of friction. In the preferred embodiment, the outer diameter d07 of ink forme roller 07 is equal to the outer diameter d04 of plate cylinder 04, which supports at least one printing forme, in particular at least one printing plate. At least one printing plate is arranged, or at least can be arranged, on the lateral surface of plate cylinder 04, so that in the embodiment in which the outer diameter d04 of plate cylinder 04, which carries the printing plate, is equal to the outer diameter d07 of ink forme roller 07, the circumferential lengths of plate cylinder and ink forme roller are also identical. In the preferred embodiment, in the first operating position of the inking unit 06 that cooperates with plate cylinder 04, in which ink forme roller 07 and anilox roller 08 are thrown onto one another, ink forme roller 07 is thrown onto plate cylinder 04, and plate cylinder 04 is thrown onto segmented wheel 03, at least the respective centers of plate cylinder 04, ink forme roller 07 and anilox roller 08 are arranged along the same straight line G. To detect the rotation of ink forme roller 07, a detection device in the form of a rotary sensor is provided, with this rotary sensor being connected rigidly, in particular, to a shaft of ink forme roller 07. The control unit uses the signal generated by the rotary encoder when ink forme roller 07 is in rotation to adjust or if necessary track the rotational speed and/or angular position of ink forme roller 07 by means of the rotation of anilox roller 08 such that synchronization between plate cylinder 04 and ink forme roller 07 is or will be established, and therefore the circumferential speed of ink forme roller 07 coincides with the circumferential speed of plate cylinder 04 within predefined permissible tolerance limits. To achieve this goal, it may be provided that the control unit adjusts the circumferential speed of anilox roller 08, preferably during the adjustment phase executed by said control unit, in such a way that the circumferential speed of the anilox roller increases or decreases relative to the circumferential speed of plate cylinder 04 particularly for a brief period of time—and thus not permanently. By configuring plate cylinder 04 and ink forme roller 07 as having equal circumferential lengths, and by establishing synchronization between plate cylinder 04 and ink forme roller 07, the adverse effect on print quality of ghosting is largely avoided. The drive concept described herein involving a friction-driven ink forme roller 07 also has the advantage that a separate drive is not required for ink forme roller 07, which saves on costs and also facilitates replacement of ink forme roller 07, for example during maintenance or repair operations, due to the simpler mechanical construction.

In its preferred embodiment, ink forme roller 07 has a closed, preferably rubberized lateral surface. The lateral surface of inking unit roller 08, preferably embodied as anilox roller 08, is coated with a ceramic, for example, wherein a hachure of, for example, 80 lines per centimeter of axial length of anilox roller 08 or a saucer structure is formed in the ceramic layer. To enable the largest possible volume of ink to be fed into the roller train of inking unit 06 with each revolution of anilox roller 08, the outer diameter d08 of anilox roller 08 is preferably configured as larger than the outer diameter d07 of ink forme roller 07. Thus anilox roller 08 should have the greatest delivery volume possible. In FIG. 2, rotational arrows are used to indicate the direction of rotation of segmented wheel 03, plate cylinder 04, ink forme roller 07 and anilox roller 08.

In the preferred embodiment, at least the inking unit roller 08, preferably embodied as anilox roller 08, has a temperature control device for controlling the temperature of the lateral surface of said roller. The temperature control device of anilox roller 08 operates, for example, with a temperature control fluid that is introduced into the interior of anilox roller 08, wherein the temperature control fluid is water, for example, or some other liquid coolant. The temperature control device of anilox roller 08 can be used to influence the delivery volume of anilox roller 08, because it influences the viscosity of the ink to be transported by inking unit 06. The delivery volume of anilox roller 08 and the viscosity of the ink to be transported by inking unit 06 in turn ultimately impact the ink density of the ink to be applied to the cylindrical lateral surface of hollow body 01 to be imprinted. The thickness of the ink film formed by the ink to be applied to the cylindrical lateral surface of the hollow body 01 to be printed on is approximately 3 μm, for example.

Figure 4:
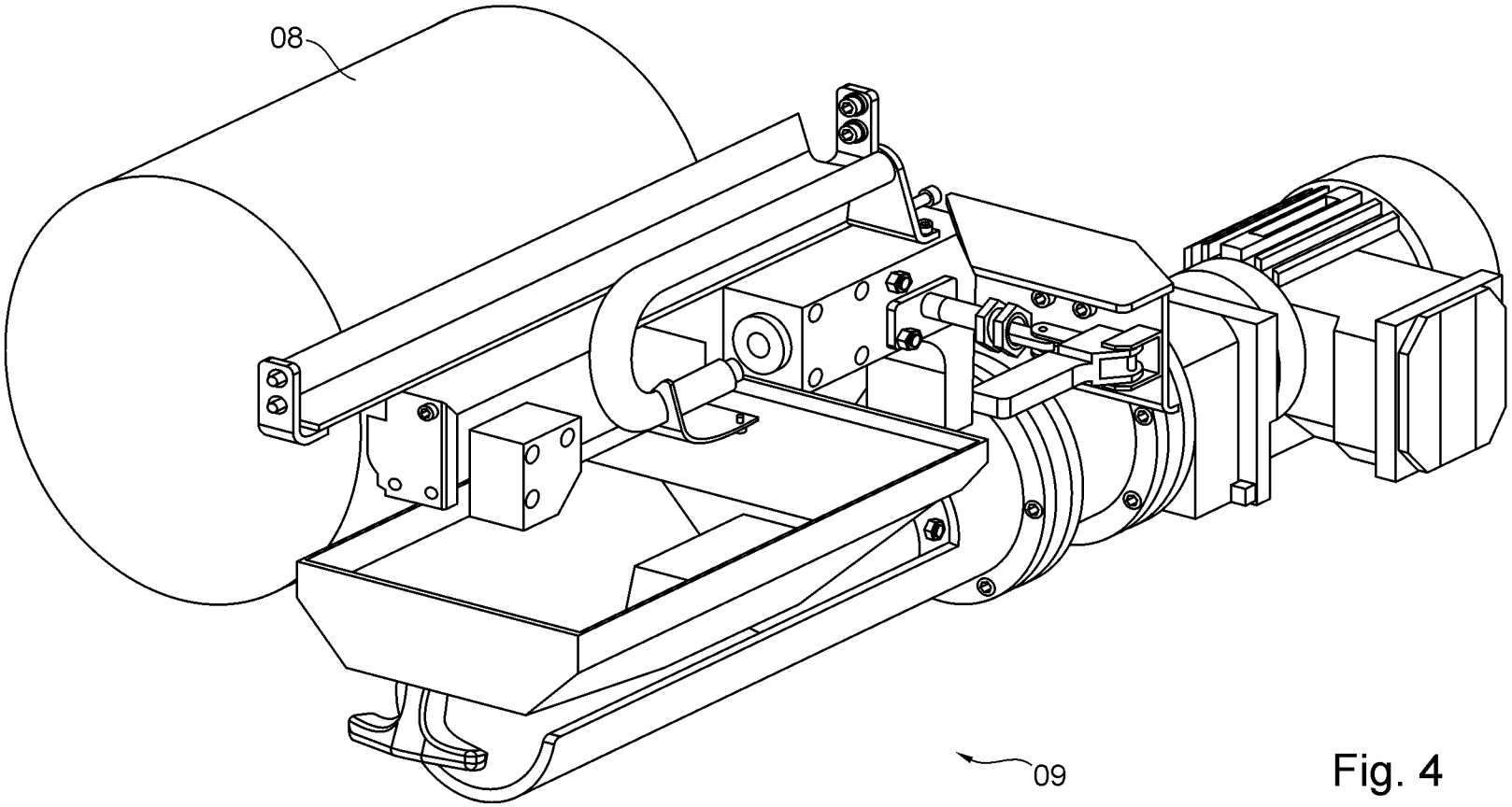
FIG. 4 a chamber doctor blade system, particularly for the inking unit shown in FIGS. 2 and 3.

The ink reservoir of inking unit 06 is embodied, for example, as a chamber doctor blade system 09 that operates in conjunction with anilox roller 08. Advantageously, in this chamber doctor blade system 09 at least one ink trough, a doctor blade bar which is or at least can be placed axially parallel onto anilox roller 08, and preferably also a pump for conveying the ink form a single structural unit. This chamber doctor blade system 09 is preferably held or mounted in inking unit 06, i.e. on a frame of inking unit 06, on only one side by means of a suspension, for example, so that this structural unit can be easily removed from inking unit 06 laterally after being released from the frame of inking unit 06, that is to say, by a movement directed axially parallel to anilox roller 08, for example by pulling on a handle arranged on this structural unit, and can thus be replaced. This structural unit of chamber doctor blade system 09 preferably forms a cantilever arm on a side frame of inking unit 06. FIG. 4 shows a perspective view of chamber doctor blade system 09 formed as a structural unit in cooperation with anilox roller 08 of inking unit 06.

Once anilox roller 08 has received ink from the ink reservoir, i.e. in particular from chamber doctor blade system 09, anilox roller 08 transports this ink immediately and directly or via additional rollers of the roller train which is part of inking unit 06 to the preferably only one ink forme roller 07. In the direction of rotation of anilox roller 08, in an area downstream of chamber doctor blade system 09, which is placed against anilox roller 08, between chamber doctor blade system 09 and ink forme roller 07, a rider roller 13 preferably is or at least can be thrown onto anilox roller 08 for the purpose of improving the evenness of ink application to anilox roller 08 and the ink transport thereof. Rider roller 13 is arranged axially parallel to anilox roller 08. Rider roller 13 is not considered to be part of the roller train of inking unit 06 because it does not transfer ink from anilox roller 08 to any other roller. Rider roller 13, which is rotationally driven by anilox roller 08, e.g. by friction, has a rubberized lateral surface, for example. As rider roller 13, which is thrown onto anilox roller 08, rolls along the lateral surface of anilox roller 08, it draws a portion of the ink that has been received by anilox roller 08 from chamber doctor blade system 09 out of the hachure or the saucers of anilox roller 08 and applies at least some of this ink to lands formed on the lateral surface of anilox roller 08. Rider roller 13 rolling on anilox roller 08 thus causes anilox roller 08 to deliver a greater volume of ink to ink forme roller 07. In another sequence, with an anilox roller 08 having a temperature control device, for example, the effectiveness of controlling ink density is improved by rider roller 13 rolling on anilox roller 08 and contributing to supplying a greater volume of ink. Irrespective of the specific configuration of anilox roller 08, i.e., with or without a temperature control device, rider roller 13 rolling on anilox roller 08 therefore reduces both density differences that may occur as a result of manufacturing tolerances of anilox roller 08 and the risk that the hachure or saucers of anilox roller 08 may be visible on the printing substrate, i.e. in this case on the lateral surface of hollow body 01 to be printed on, as a result of an insufficient application of ink at least in patches.

In a highly advantageous embodiment of the device for printing on hollow bodies, a plate changer 14 is provided, preferably in a fixed assignment to at least one, preferably to each printing forme cylinder, in particular plate cylinder 04, with which plate changer the printing forme intended for the printing forme cylinder in question, or the printing plate intended for the plate cylinder 04 in question can be replaced, preferably in an automated fashion, i.e. without intervention by operators, for example within the device in question for printing on or decorating hollow bodies 01, each of which has a cylindrical lateral surface in particular. With this plate changer 14, a printing forme 48 placed on a carrier 50 intended for this printing forme cylinder 04 can be replaced within this device, preferably from the side of the printing unit in question that lies diametrically opposite the side that holds the chamber doctor blade system 09 structural unit. In the device for printing on hollow bodies, for example, plate changer 14 is arranged on the printing unit in question, assigned to the printing forme cylinder 04 thereof, which printing unit comprises inking unit 06 with the cantilevered structural unit of chamber doctor blade system 09, wherein the printing forme 48 on carrier 50 and intended for this printing forme cylinder 04 is or at least can be supplied to this plate changer 14 from the side of the printing unit in question which is diametrically opposite the side that holds the structural unit of chamber doctor blade system 09.

FIGS. 5 and 6 show a perspective illustration of a preferred embodiment of a very advantageously configured plate changer 14 in two different operating positions for performing a plate change or printing forme change that can be completed within a very short set-up time, reliably and preferably while maintaining register. FIG. 5 shows a first operating position, in which a printing plate 48 on a carrier 50, as seen in FIG. 2, for example, can be brought forward to the printing forme cylinder or plate changer 14 or removed from plate changer 14 axially to the side next to the printing unit. FIG. 6 shows a second operating position, in which, immediately upstream of printing forme cylinder or plate cylinder 04 and lengthwise thereto, a printing plate 48, on its carrier 50, can be placed from plate changer 14 directly onto the assigned plate cylinder 04, or a printing plate 48, on its carrier 50, can be removed from plate cylinder 04 and carried away with plate changer 14 to its first operating position. Plate changer 14 has a particularly flat, for example table-shaped bearing surface 16, on which, for example, an entire printing plate 48, on its carrier 50 and, that is or will be arranged on plate cylinder 04, can preferably be placed. Bearing surface 16 is preferably arranged such that it can be moved back and forth linearly between at least two defined positions, in particular longitudinally with respect to the rotational axis of the assigned printing forme cylinder or plate cylinder 04. In a first position of bearing surface 16, located laterally next to the printing unit, this movable, in particular positionable bearing surface 16 of plate changer 14 occupies its first operating position, and in a second position of bearing surface 16 located directly in front of and along printing forme cylinder or plate cylinder 04, the bearing surface occupies its second operating position. In the first operating position, bearing surface 16 of plate changer 14 is located at least partially in front of an end face of the printing forme cylinder or plate cylinder 04 in question. In the second operating position, bearing surface 16 of plate changer 14 is preferably at least partially below the lateral surface of printing forme cylinder or plate cylinder 04. Bearing surface 16 of plate changer 14 is moved, for example, along a cross member 17 arranged longitudinally with respect to printing forme cylinder or plate cylinder 04. Bearing surface 16 of plate changer 14 thus has an axial movement path with respect to the printing forme cylinder or plate cylinder 04 in question. At the positions that define the first and second operating positions of plate changer 14, the movement of bearing surface 16 is limited in each case by a stop, for example, which is not specifically shown. At least the carrier 50 of the printing plate 48 in question is formed, for example, by a trimming process, which is carried out particularly using register marks such that the printing plate in question can be arranged on bearing surface 16 of plate changer 14 so as to maintain register. For this purpose, at least two edges of the carrier 50 of the printing plate in question, which are arranged at right angles relative to one another, are brought into physical contact, with stops arranged on the bearing surface 16 of plate changer 14, wherein a first edge of the carrier of the printing plate in question bears against one of first register stops 40; 41, and a second edge, orthogonal to the first edge, of the carrier of the printing plate in question bears against a second stop 47. The position of one of these two stops 40; 41 or 47 is preferably variable, and in particular is adjustable. By adjusting the stop 40; 41 or 47 that has variable positioning, the printing plate in question can be aligned so as to maintain register. The stop that has variable positioning can be adjusted manually, or automatically by means of a control unit. Since the carrier 50 of the printing plate 48 is supplied true to register to the plate cylinder 04 in question, no centering pin, for example, and no other register device is provided on plate cylinder 04. The first stops 40; 41 are each embodied as a cylindrical or conical machine element arranged vertically upright on bearing surface 16 of plate changer 14, each preferably being embodied as a vertically upright register pin on bearing surface 16 of plate changer 14. The second stop 47 may be an elongated, raised edge of the bearing surface portion 16 of the plate changer 14, as seen in FIGS. 5 and 6.

In its preferred embodiment, in addition to bearing surface 16 for receiving a printing plate to be supplied true to register to plate cylinder 04, for example, plate changer 14 has a compartment, for example, into which a printing plate removed from plate cylinder 04, for example, can be placed. A printing plate 48, held by means of its carrier 50, in particular magnetically on the lateral surface of the relevant plate cylinder 04 by the magnets 46 is or at least can be lifted off of the lateral surface of plate cylinder 04 in question, for example by means of a tool guided tangentially with respect to the printing forme, for example by means of a spatula guided between the carrier 50 of the printing plate 48 and the lateral surface of the plate cylinder 04 in question. The end of the carrier 50 of relevant printing plate 48 that has been lifted off of the lateral surface of plate cylinder 04 in question is inserted into the relevant compartment of plate cylinder 04 by a rotation of the plate cylinder 04 in question. By continuing this rotation of the plate cylinder 04 in question, the entire printing plate that has been separated from the lateral surface of plate cylinder 04 in question is then pushed into the relevant compartment of plate changer 14.

A printing plate to be supplied, true to register, to the plate cylinder 04 in question is held, after being aligned true to register, by a magnetic holding force provided by magnets 44 spaced on bearing surface 16 of plate changer 14. At least one plunger 42, and preferably two plungers 42; 43 arranged spaced longitudinally along the bearing surface 16 of the plate changer 16 in question are provided, each having a direction of action directed opposite the magnetic holding force, with this direction of action being directed substantially orthogonally to bearing surface 16 of plate changer 14, for example. With this at least one plunger 42; 43, at least one end of the printing plate 48, on its carrier 50, and held on bearing surface 16 of plate changer 14 by the magnets 44, said end facing the plate cylinder 04 in question, can be released from this bearing surface 16, and can be transferred to the plate cylinder 04 in question by a stroke movement of the at least one plunger 42; 43. The at least one plunger 42; 43 is or at least can be actuated pneumatically, for example. The printing forme 48 or the printing plate 48, on its carrier 50, is held on bearing surface 16 of plate changer 14 or on the lateral surface of plate cylinder 04 by means of magnets 44, with each of these magnets 44 preferably being embodied as a permanent magnet. The above-described configuration of plate cylinder 04 has the advantage that no conveyor device is required for transferring the printing plate 48, on its carrier 50, to the relevant plate cylinder 04 or for removing the printing plate from the relevant plate cylinder 04, and therefore plate changer 14 can be implemented very cost-effectively. In particular, a plate change can be performed automatically using the plate changer 14 described above.

The throwing on and/or throwing off of printing forme cylinder or plate cylinder 04, ink forme roller 07, and/or anilox roller 08, and/or the adjustment of the contact force exerted by each of these is carried out using a throw-on/throw-off mechanism, illustrated by way of example in FIGS. 2 and 3, which will now be described in detail.

In the preferred embodiment, printing forme cylinder or plate cylinder 04 is mounted particularly at both ends on a load arm of a preferably single-sided first lever assembly 18 consisting of a force arm and the load arm, wherein the force arm and the load arm, which is arranged at a fixed angle relative to the force arm, of this first lever assembly 18 are pivotable together about a first rotational axis 19 directed axially parallel to plate cylinder 04. A first drive 21 in the form of a hydraulic or pneumatic working cylinder, for example, preferably controllable by a control unit, is disposed in an operative connection to the force arm of the first lever assembly 18, for the purpose of applying torque about the first rotational axis 19, wherein upon actuation of this first drive 21, depending on its direction of action, the printing forme cylinder or plate cylinder 04 arranged on the load arm of this first lever assembly 18 is either thrown off of or thrown onto a printing blanket of segmented wheel 03, for example. To limit the contact force exerted by printing forme cylinder or plate cylinder 04 against the relevant printing blanket of segmented wheel 03, for example, a first stop 22 for the force arm of the first lever assembly 18 is provided, for example, which limits the path traveled by the pivoting movement of printing forme cylinder or plate cylinder 04 toward segmented wheel 03. The contact force exerted by printing forme cylinder or plate cylinder 04 against segmented wheel 03 may be adjusted using the first drive 21.

In the preferred embodiment, ink forme roller 07 is also mounted particularly at both ends on a load arm of a preferably single-sided second lever assembly 23 consisting of a force arm and the load arm, wherein the force arm and the load arm of this second lever assembly 23 are pivotable together about the first rotational axis 19, which is aligned axially parallel to plate cylinder 04. In the preferred embodiment, inking unit roller 08, embodied, for example, as an anilox roller 08, is likewise mounted particularly at both ends on a load arm of a preferably single-sided third lever assembly 24 consisting of a force arm and the load arm, wherein the force arm and the load arm of this third lever assembly 24 are pivotable together about a second rotational axis 26, which is aligned axially parallel to anilox roller 08, and wherein the second rotational axis 26 of the third lever assembly 24 is disposed on the second lever assembly 23. The second rotational axis 26 is preferably embodied as fixed on the second lever assembly 23. On the load arm of the first lever assembly 18, a preferably controllable second drive 27 is arranged, which when operated, acts on the force arm of the second lever assembly 23, and which can be used to throw ink forme roller 07 onto or off of plate cylinder 04, depending on the operating direction of second drive 27. On the load arm of the second lever assembly 23, a preferably controllable third drive 28 is arranged, which when operated, acts on the force arm of the third lever assembly 24, and which can be used to throw anilox roller 08, preferably together with chamber doctor blade system 09, onto or off of ink forme roller 07, depending on the operating direction of third drive 28. Second drive 27 and/or third drive 28 are each also embodied as a hydraulic or pneumatic working cylinder, for example. It may be provided that second drive 27 and third drive 28 are or at least can be actuated together, for example, and preferably also simultaneously. The pivoting movement of the load arm of second lever assembly 23 is limited, for example, by a first stop system 29 which is preferably adjustable, particularly by means of an eccentric, whereby the contact force exerted by ink forme roller 07 against printing forme cylinder or plate cylinder 04 also is or at least can be limited. The pivoting movement of the load arm of third lever assembly 24 is limited, for example, by a second stop system 31 which is preferably adjustable, particularly by means of an eccentric, whereby the contact force exerted by anilox roller 08 against ink forme roller 07 also is or at least can be limited. FIG. 2 shows an example of a first operating mode, in which first drive 21 and second drive 27 and third drive 28 are not activated, or each is in its idle state, and as a result anilox roller 08 is thrown onto ink forme roller 07, and ink forme roller 07 is thrown onto printing forme cylinder or plate cylinder 04, and printing forme cylinder or plate cylinder 04 is thrown onto segmented wheel 03. FIG. 3 shows an example of a second operating mode, in which first drive 21 and second drive 27 and third drive 28 are activated, or each is in its operating state, and as a result anilox roller 08 is thrown off of ink forme roller 07, and ink forme roller 07 is thrown off of printing forme cylinder or plate cylinder 04, and printing forme cylinder or plate cylinder 04 is thrown off of segmented wheel 03. The force arm and/or load arm of each of the three aforementioned lever assemblies 18; 23; 24 is or are each embodied as a pair of opposing lever bars or side frame walls, for example, between which, in the allocation as described above, either printing forme cylinder or plate cylinder 04 or ink forme roller 07 or anilox roller 08 is arranged. The three aforementioned lever assemblies 18; 23; 24 are each located in different vertical planes that are spaced from one another, so that the lever assemblies cannot mutually impede their respective ability to swivel.

While a preferred embodiment of a printing unit having a plate cylinder and a plate changer, in accordance with the present invention, has been set forth fully and completely hereinabove, it will be apparent to one of skill in the art that various changes could be made without departing from the true spirit and scope of the subject invention which is accordingly to be limited only by the appended claims.

The invention claimed is:

1. A printing unit arranged in a device for printing on hollow bodies, the device for printing on hollow bodies having a segmented wheel with a plurality of printing units spaced around a periphery of the segmented wheel, the plurality of printing units each having a printing forme cylinder the forme cylinder of at least one of the plurality of printing units being adapted for printing in a letterpress printing process, wherein a plate changer is provided and is positioned adjacent to the printing forme cylinder of at least one of the printing units, wherein the plate changer has a bearing surface on which a printing forme which is one of arranged and is to be arranged on the printing forme cylinder can be placed, wherein this bearing surface is arranged such that it can be moved back and forth longitudinally with respect to a rotational axis of the printing forme cylinder between at least first and second positions, characterized in that the printing forme is arranged true to register on the bearing surface of the plate changer, wherein at least two edges of a carrier of the printing forme are brought into physical contact with register stops arranged on the bearing surface of the plate changer, wherein a first edge of the carrier of the printing forme is disposed so as to strike a first register stop and a second edge of the carrier of the printing forme, orthogonal to the first edge, is disposed so as to strike a second register stop, wherein the printing forme positioned on the bearing surface is held on the bearing surface of the plate changer by a magnetic holding force, wherein at least one plunger having a direction of action directed opposite the magnetic holding force is provided, with which at least one plunger at least one end of the carrier of the printing forme held on the bearing surface of the plate changer and facing toward the printing forme cylinder can be released from this bearing surface and can be transferred to the printing forme cylinder.

2. The printing unit according to claim 1, characterized in that when the bearing surface is in the first position, and is located laterally next to the printing unit, the plate changer occupies a first operating position, in which a printing forme on the carrier can be one of brought forward on the plate changer and can be removed from the plate changer, and in that when the bearing surface is in the second position, and is located directly in front of, and along the printing forme cylinder, the plate changer occupies a second operating position, in which a printing forme on the carrier can be one of placed from the plate changer directly onto the printing forme cylinder and can be removed from the printing forme cylinder and can be carried away with the plate changer to the first operating position of the plate changer.

3. The printing unit according to claim 1, characterized in that when the plate changer is in a first operating position, the bearing surface of the plate changer is located at least partially in front of an end face of said printing forme cylinder.

4. The printing unit according to claim 1, characterized in that when the plate changer is in a second operating position, the bearing surface of the plate changer is located at least partially below a lateral surface of the printing forme cylinder.

5. The printing unit according to claim 1, characterized in that a movement path extending parallel to the printing forme cylinder can be executed by the bearing surface of the plate changer.

6. The printing unit according to claim 1, characterized in that the at least one plunger one of is and can be pneumatically actuated and is embodied as executing a stroke movement.

7. The printing unit according to claim 1, characterized in that a position of one of the first register stop and the second register stop is variable and adjustable.

8. The printing unit according to claim 7, characterized in that an adjustment of the register stop, the position of which is variable, is one of performed and can be performed automatically.

9. The printing unit according to claim 1, characterized in that the bearing surface of the plate changer is embodied as flat and table-shaped.

10. The printing unit according to claim 1, characterized in that the carrier for the printing forme can be placed in its entirety on the bearing surface.

11. The printing unit according to claim 1, characterized in that the movement of the bearing surface of the plate changer is executed along a cross member arranged longitudinally relative to the printing forme cylinder.

* * * * *